US007048504B2

(12) United States Patent
Bailleul et al.

(10) Patent No.: US 7,048,504 B2
(45) Date of Patent: May 23, 2006

(54) MACHINE STATOR AND MOUNTING AND DISMOUNTING METHODS

(75) Inventors: Pierre Yves Bailleul, Soignolles en Brie (FR); Sebastien Goux, Evry (FR); Rene Lefloch, Moret sur Loing (FR); Patrice Mazzotta, Vigneux/Seine (FR); Gabriel Radeljak, Le Raincy (FR); Dominique Raulin, Avon (FR); Alain Repussard, Le Chatelet en Brie (FR); Michel San Basilio, Vaux le Penil (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/515,180

(22) PCT Filed: May 7, 2003

(86) PCT No.: PCT/FR03/01415

§ 371 (c)(1),
(2), (4) Date: Nov. 26, 2004

(87) PCT Pub. No.: WO2004/101958

PCT Pub. Date: Nov. 25, 2004

(65) Prior Publication Data

US 2005/0232759 A1 Oct. 20, 2005

(51) Int. Cl.
*F01O 9/04* (2006.01)

(52) U.S. Cl. ..... 415/190; 415/189; 415/209.2; 415/209.3; 415/214.1; 29/889.22

(58) Field of Classification Search ..... 415/209.1, 415/209.2, 209.3, 209.4, 189–190, 199.5, 415/214.1; 29/889.22
See application file for complete search history.

(56) References Cited

U.S. PATENT DOCUMENTS

| | | | | |
|---|---|---|---|---|
| 3,067,983 A | | 12/1962 | Koziura | |
| 3,597,106 A | * | 8/1971 | Anderson | 415/214.1 |
| 4,425,078 A | | 1/1984 | Robbins | |
| 4,684,320 A | | 8/1987 | Kunz | |
| 4,875,828 A | | 10/1989 | Willkop | |
| 5,462,403 A | | 10/1995 | Pannone | |
| 5,564,897 A | | 10/1996 | Mansson | |

FOREIGN PATENT DOCUMENTS

| | | | | |
|---|---|---|---|---|
| EP | 0 528 520 | | 2/1993 | |
| EP | 0 844 369 | | 5/1998 | |
| FR | 2 832 179 | | 5/2003 | |
| GB | 624777 A | * | 6/1949 | 415/214.1 |

* cited by examiner

*Primary Examiner*—Christopher Verdier
(74) *Attorney, Agent, or Firm*—Oblon, Spivak, McClelland, Maier & Neustadt, P.C.

(57) ABSTRACT

A machine stator and assembly and disassembly methods. The elements of a casing portion are formed of consecutive shells in line with grooves configured to house roots of guide vane stages that are fixed in place by springs and pins for stopping rotation. The elements are arranged in a complete circle, and the assembly is made by axially separating the elements to insert the guide vane stages between the elements by a radial movement.

6 Claims, 5 Drawing Sheets

MACHINE STATOR AND MOUNTING AND DISMOUNTING METHODS

Figure 1:
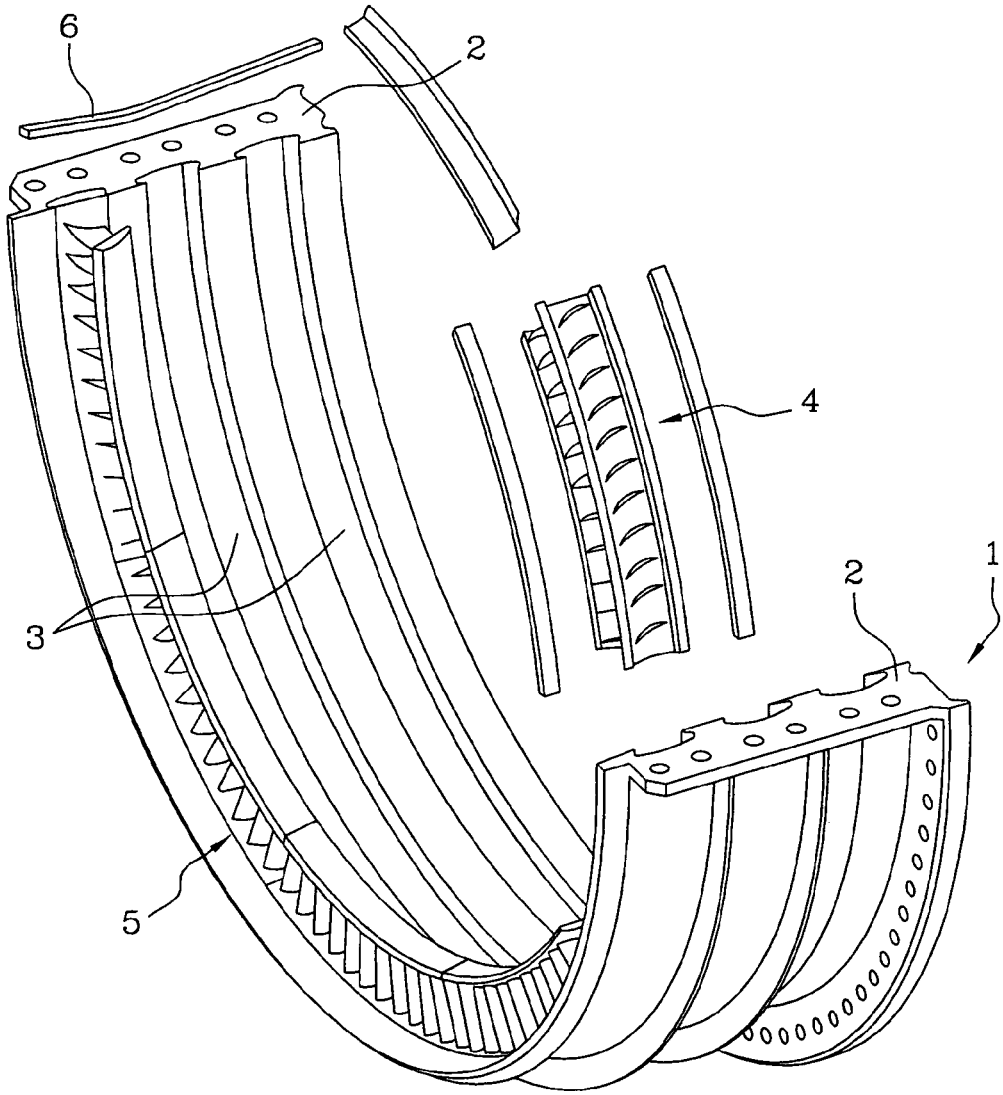

This description applies to a machine stator and particular assembly and disassembly methods that can be used with it.

The field of this invention is rotating machines in which the stator carries stages of fixed vanes called guide vane stages that alternate with circular stages of mobile blades on the rotor. The assembly and disassembly of such machines is usually complicated due to nesting of vane stages, which makes maintenance operations particularly long and expensive. This is why the external stator casing in the stator structure shown in FIG. 1 comprises two semi-circular half-shells 1 (only one is shown, the other being similar and symmetric) joined together by flat flanges 2 provided with semi-circular grooves 3 in which the angular sectors 4 of the guide vane stages 5 are slid. The movements of the angular sectors 4 sliding in the grooves 3 need to be stopped, which is achieved using a strip 6 in front of the grooves 3 at the junction of the half-shells 1 between the joining flanges 2, in order to prevent movement of the angular sectors 4.

It is very easy to disassemble this particular stator since all that is necessary is to unbolt the flanges 2 and to separate the two half-shells 1 by a simple radial movement. The angular sectors 4 may also be easily extracted from the grooves 3, and the rotor blades are completely exposed. However, there is still the disadvantage that it is not very precise to assemble the half-shells 1 and clearances of a few hundredths or a few tenths of a millimetre have to be left in the machine which reduces its performances by being the source of gas leaks. It should be noted also that the strip 6 stops only the complete assembly of guide vane stages 5; which does not prevent the angular sectors 4 from moving and causing vibrations. This is why other stator constructions are also attractive.

Another design is described in document U.S. Pat. No. 5,564,897 in which the casing is composed of circular shells assembled to each other by screws and that are assembled one after the other. Grooves in which the stands of the vane stages penetrate are used to insert the blades by a radial movement between the shells, and the assembly is then made by an axial movement bringing the shells towards each other. The blades are retained by hooks projecting on both faces and entering into rebates formed in the opposite faces of the grooves. Finally, axial orientation pins stop blade movements in the tangential direction in the grooves.

However, the machine described in document U.S. Pat. No. 5,564,897 has a fairly simple structure, and the particular assembly arrangement is preferably intended for a low pressure compressor. Machines for aircraft are more complex, and maintenance is necessary particularly for the high pressure compressor, and more particularly for stages close to the combustion chamber that are subjected to high pressures and temperatures. But unfortunately this is the position at the heart of the machine at which it is most difficult to extract blades and vanes for repair. With known arrangements, the machine stator has to be disassembled at the front and back of this highly stressed area, and the machine rotor also has to be removed. The design in U.S. Pat. No. 5,564,897 is not applicable as such for at least two reasons: the shells cannot be moved freely in the axial direction unless the machine is disassembled—for reasons which we will be described in detail later; and the vanes are not well retained when the shells are not assembled, which probably means that a holding tool has to be used which will be a problem in this case since the tools cannot be used without sufficient access to the vanes so that they can be inserted and removed.

The invention proposed here provides a means of extracting stator vanes by a radial movement after an axial movement to move away the circular shells assembled to form the casing, as described in prior art, but the arrangement is innovative in that this result can be obtained even for high pressure compressor vanes in the combustion chamber or another area with difficult access in a complex and fairly small aeronautical turbomachine.

One essential means is that the vanes remain retained by one of the shells even when displacement of a nearby shell has freed them: the vane roots are provided on one side with curved hooks that penetrate into a complementary shaped rebate, closed partially by a radially oriented lip that retains the hooks in the rebate. An axial expansion spring is housed at the bottom of the rebate to press on the hook and to maintain it, and the rest of the vane, in a fixed position: no external tooling is then necessary to guarantee correct reassembly of the stator.

Figure 2:
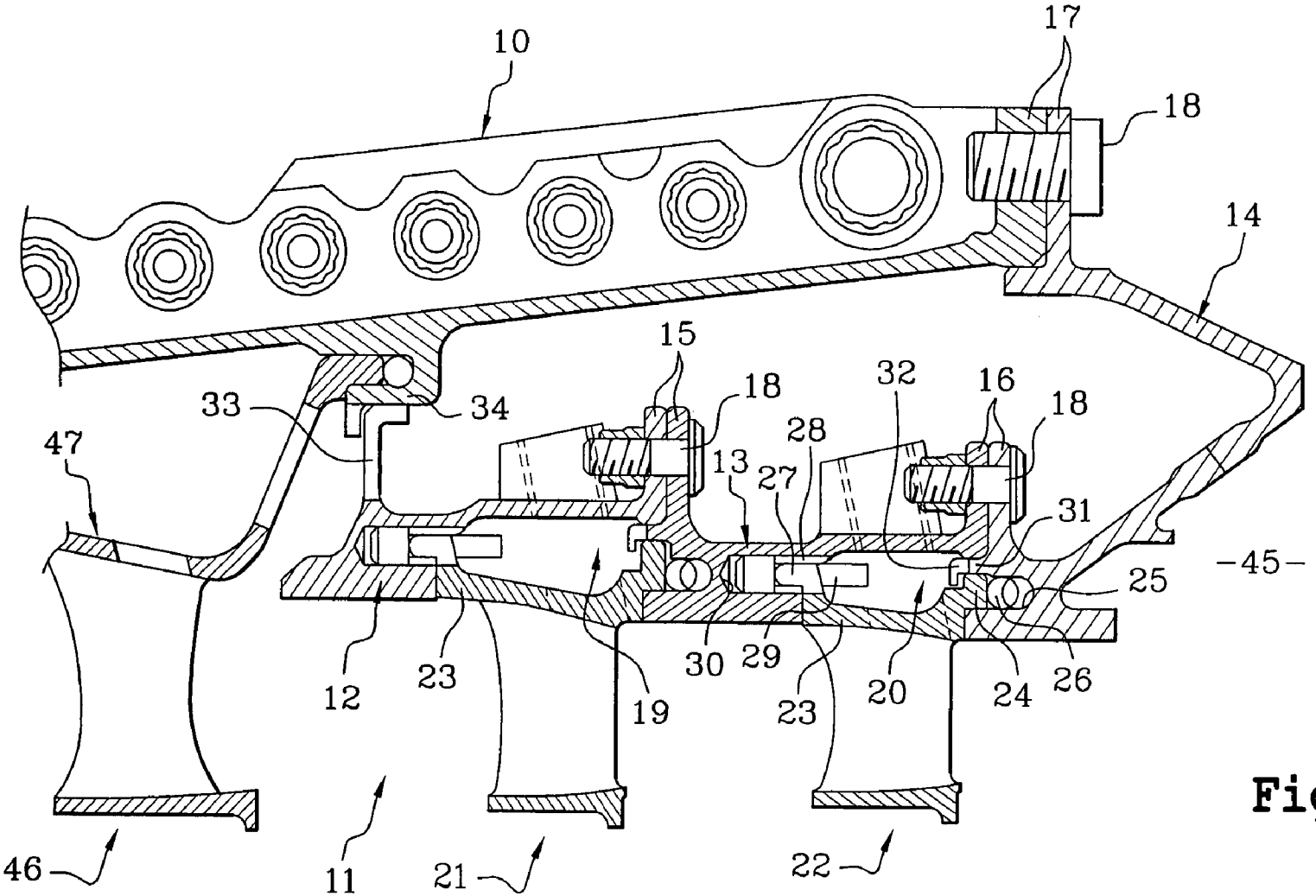
Figure 3:
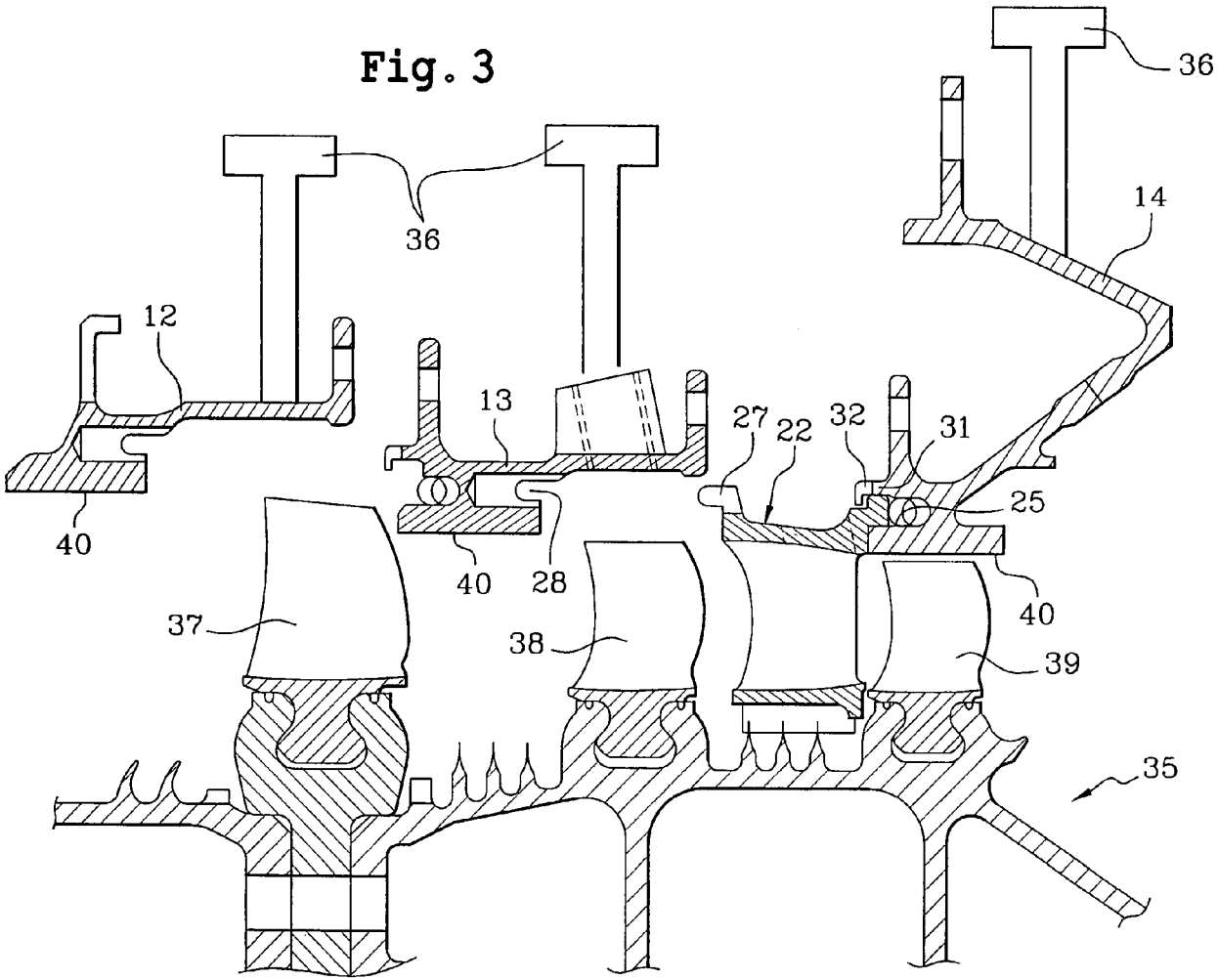
Figure 4:
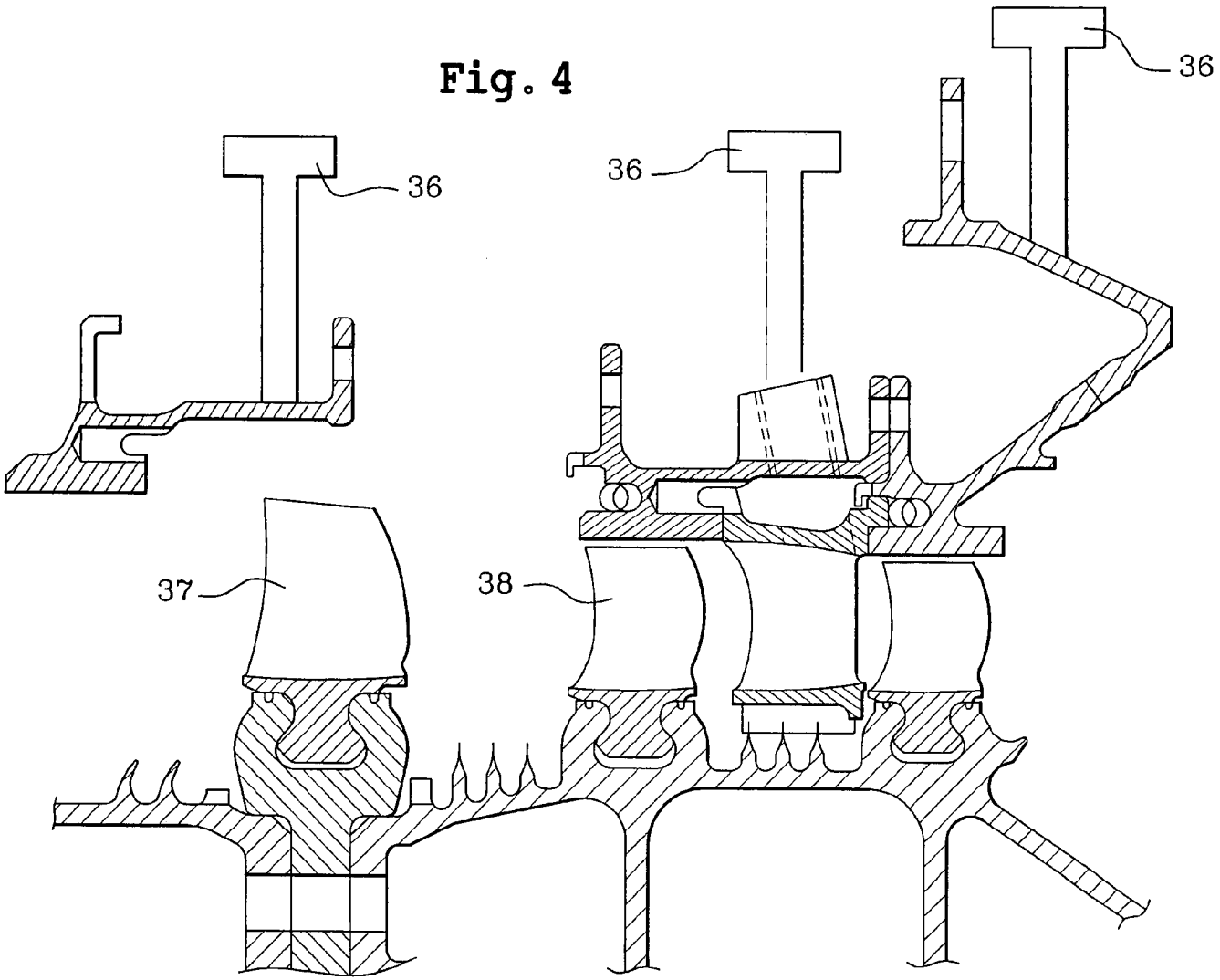
Figure 5:
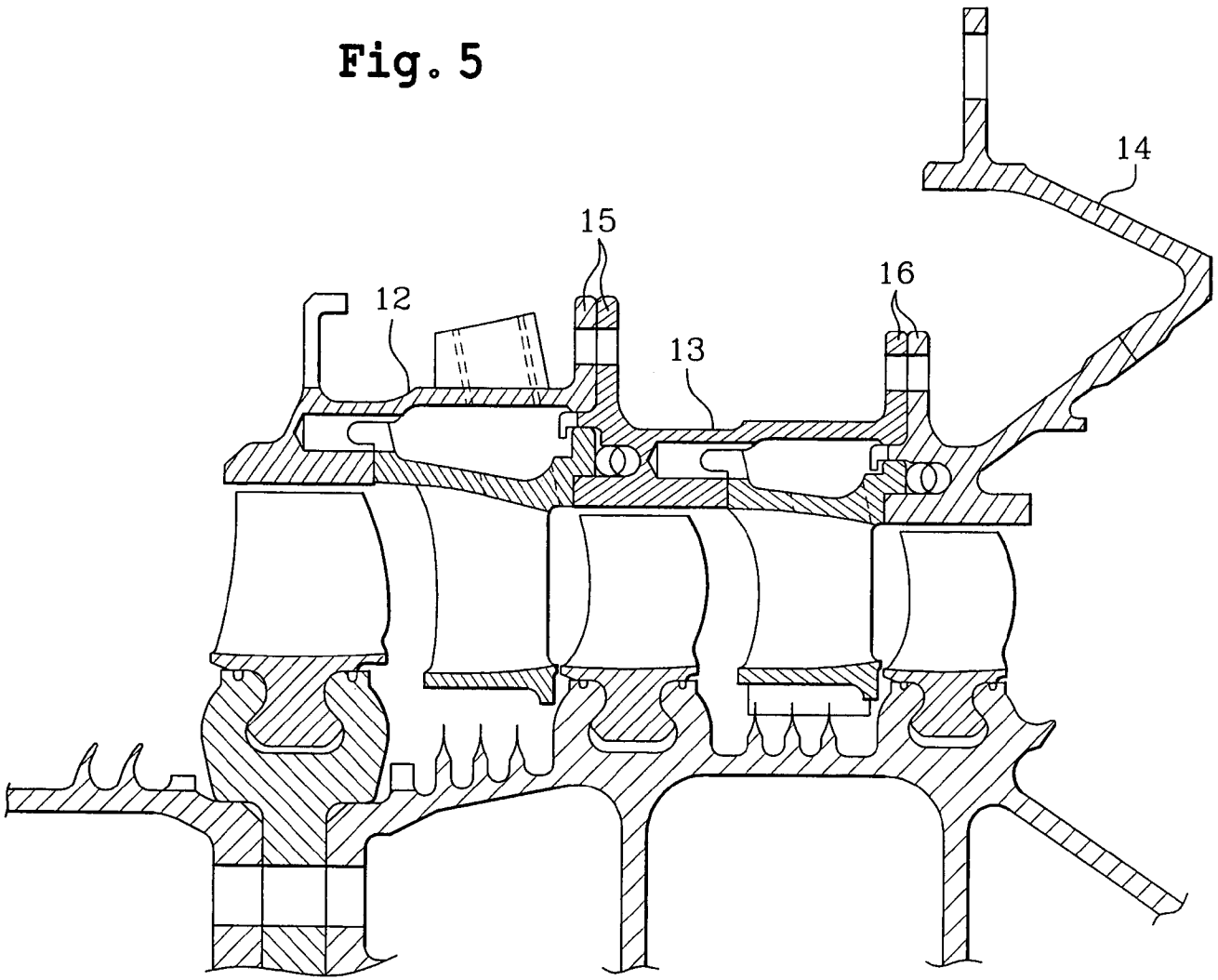

Other aspects, details and characteristics of the invention will now be described with reference to the following figures:

FIG. 1, already described, illustrates a stator casing;

FIG. 2 illustrates a stator casing according to the invention, and FIGS. 3 to 5 illustrate steps in its assembly.

FIG. 2 shows that the stator comprises an outer cover 10 supporting the casing 11 that in this case is composed of a front shell 12, a back shell 13 and a shock absorbing ring 14 (forming a third shell in the sense of the invention); the shells 12 and 13 are adjacent to each other and are bolted together by pairs of flanges 15, the back shell 13 and the shock absorbing ring 14 are bolted together by pairs of flanges 16, and the shock absorbing ring 14 is bolted to the cover 10 by pairs of flanges 17; the junction bolts are marked by the general reference 18. The shells 12 and 13 of the shock absorbing ring 14 extend around a complete turn.

The casing 11 described herein is placed on the downstream side of a high pressure compressor of a turbomachine, in contact with the combustion chamber that is not shown in detail but which is present in the adjacent zone 45 beyond the shock absorber ring 14. Therefore, the front of the turbomachine corresponds to the left of FIG. 2 and subsequent figures. The cover 10 carries at least one guide vane stage 46 just on the upstream side of the stages to which the invention is applicable. The cover 10 is composed of two semi-circular halves assembled by opposite straight lines (assembly in half-shells) so that it can be disassembled easily without assembly inaccuracies being particularly problematic in this case since the shell 12 and the shock absorbing ring 14 provide good centering and the cover 10 is not subjected to severe temperature loads.

Grooves 19 and 20 along the direction towards the inside of the stator and shared by the back shell 13, and the front shell 12 and the shock absorber ring 14 respectively, are located under the pairs of flanges 15 and 16 respectively. The grooves 19 and 20 resemble the grooves shown in the design in FIG. 1 and are therefore used to retain two guide vane stages 21 and 22, the roots 23 of which are housed in them as shown here. They comprise a hook 24 at the back, curved and facing firstly backwards and then outwards, and that penetrates into a rebate 25 occupied by a corrugated circular spring 26, that applies pressure on a back face on the hook 24 and therefore push the root 23 forwards; and a hook 27 at the front, facing forwards and that penetrates into a rebate 28 into the adjacent element of the casing. This hook 27 is notched to contain a pin 29 force fitted into a drilling 30 in this casing element but that projects outwards from it facing backwards. The pin 29 opposes rotation of the angular sector of the guide vane stage 21 or 22 in which it penetrates; one pin may advantageously be provided for each guide sector, each passing through a notch in the hook 27.

Before going to describe the method of assembling and disassembling the stator, it is worth mentioning that the back shell 13 and the shock absorber ring 14 are each provided with a radial orientation lip 31 around their rebate 25, partially enclosing the rebate from the outside and being provided with a notch 32 slightly wider locally than the curved hooks 24 of the angular sectors of the guide vanes, and that this lip 31 is used to retain the hook 24 in a rebate 25 and also to support the casing element near the front, near its connecting flange 15 or 16, by adjusting itself within a concentric portion of this element. Finally, the front shell 12 comprises a rib 33 near the front, the end of which is curved to press on a hook 34 of the outside cover 10.

We will now describe FIG. 3 that represents the corresponding portion of the machine in the disassembled state, the cover 10 having been removed: the shells 12 and 13 and the shock absorber 14 are placed around a rotor 35 of the machine, using the usual sort of tools used in this technique, marked with the general reference 36 and comprising mandrels or support rings supported from a fixed frame and attachment pins. Therefore the tools 36 surrounding the shells 12 and 13 are placed on the outside, in clear locations that make it easy to use them. The rotor 35 carries a sequence of mobile blade stages 37, 38 and 39 between which the guide vane stages have to be inserted. The casing elements 11 comprise gas stream confinement surfaces 40, that will normally be in front of the moving blade stages 37 to 39, but which are not yet in their final position, since the shells 12 and 13 have been moved far forwards, while the shock absorber 14 has been moved slightly backwards. The shells 12 and 13 have moved above the rotor blade stages 37 and 39 in front of which their confinement surfaces 40 extend in the assembled state; this displacement is possible due to the slight taper in the casing 11 that becomes smaller towards the combustion chamber 45, while the taper of high pressure compressors is usually larger; this traditional taper has been maintained elsewhere, as on the outer skin 47 of the previous guide vane stage 46. The invention is applicable to a displacement of the shells 12 and 13 in the direction in which the machine diameter increases to expose the guide vane stages 21 and 22, contrary to the direction that would be natural but that is impossible due to the presence of the combustion chamber in the zone 45 that it is not to be disassembled. However, it is easy to extract the guide vane stage 46.

The first assembly step consists of inserting the back guide vane stage 22 in its place, between the useful blade stages 38 and 39 by a centripetal movement of its angular sectors making them pass one after the other through the notch 32, after which they are moved in the angular direction along the rebate 25. As is usual, they are displaced by a half-sector when the half-sector has been installed so that none of them extends completely in front of the notch 32. When the back guides stage 22 has been completely assembled, the back shell 13 may be moved backwards to insert the hooks 27 in the rebate 28 and press in contact with the lip 31: this state is shown in FIG. 4. The spring 26 correctly aligns the hooks 27 without the need for any tooling to support the sectors of the guide vane stage 22. It can be seen that the shells 12 and 13 are thus strongly separated so that the elements of the front guide vane stage 21 can be slid between them in the same way as for stage 22, between the mobile blade stages 37 and 38. The front shell 12 is then moved backwards and the shock absorber ring 14 is moved forward, so that the casing elements can be completely joined by contact between pairs of flanges 15 and 16. The outer cover 10 can then be installed. It should be noted that it is fairly easy to reach the guide vane stages 21 and 22 or the mobile blades 37, 38 and 39 without needing to disassemble the entire casing, and that the assembly is rigid and precise. Disassembly is just as easy, performing the same operations in reverse order: it would consist of separating the shells and moving them apart by an axial movement in the machine, taking the angular guide vane sectors out of the grooves and moving them in a radial movement between the shells.

The invention claimed is:

1. A turbomachine stator comprising:

a casing; and guide vane stages housed in corresponding grooves of the casing through roots, and composed of guide vane angular sectors, the guide vane angular stages alternating with rotor blade stages, the turbomachine stator being divided into adjacent circular successive shells in front of the grooves, each being fitted with connecting flanges, the grooves comprising a first rebate on a first side and axial orientation pins, wherein the grooves comprise a second rebate on an opposite second side, fitted with an axial expansion spring and partially closed by a radial orientation lip provided with a notch for inserting curved hooks of guide vane angular sectors through the lip.

2. A turbomachine stator according to claim 1, wherein the casing is surrounded by a half-shell outer cover supporting one guide vane stage located in front of a furthest of the shells, the first sides of the grooves being oriented towards the furthest of the shells in corresponding grooves.

3. A turbomachine stator according to claim 1, wherein the casing forms part of a high pressure compressor and the guide vane stages installed on the casing are adjacent to a combustion chamber, a taper in the stator becoming smaller towards the combustion chamber but being smaller at the casing than at a front of the casing, each of the shells being slidable forwards beyond one of the rotor blade stages in front of which it extends when the stator is installed.

4. A turbomachine stator according to claim 1, wherein the shells comprise concentric portions for mutual support.

5. A method for installing a turbomachine stator according to claim 1, comprising:

arranging the shells separately around a rotor;

radially inserting the guide vane angular sectors between the shells; and bringing the shells into contact by an axial movement in the turbomachine and connecting the shells as soon as the guide vane stages have been assembled in the grooves.

6. A method for disassembling a turbomachine stator according to claim 1, comprising:

disconnecting and separating the shells by an axial movement in the turbomachine;

extracting the guide vane angular sectors from the grooves; and moving the guide vane angular sectors in a radial movement between the shells.

* * * * *